US006009947A

United States Patent [19]

Wilson et al.

[11] Patent Number: 6,009,947

[45] Date of Patent: Jan. 4, 2000

[54] CASING CONVEYED PERFORATOR

[75] Inventors: Dennis R. Wilson, Ponca City, Okla.; Malak E. Yunan, Boonton Township, N.J.; Wilber R. Moyer, Blackwell; Larry K. Moran, Ponca City, both of Okla.

[73] Assignee: Conoco Inc., Ponca City, Okla.

[21] Appl. No.: 08/617,736

[22] PCT Filed: Oct. 7, 1993

[86] PCT No.: PCT/US93/09689

§ 371 Date: Mar. 18, 1996

§ 102(e) Date: Mar. 18, 1996

[87] PCT Pub. No.: WO95/09968

PCT Pub. Date: Apr. 13, 1995

[51] Int. Cl.[7] ..... E21B 43/12

[52] U.S. Cl. ..... 166/299; 166/63; 166/100; 166/242.1; 166/369

[58] Field of Search ..... 166/63, 100, 242.1, 166/299, 297, 55.1, 369; 175/4.53, 2

[56] References Cited

U.S. PATENT DOCUMENTS 3,318,381 5/1967 Brandt .
3,385,364 5/1968 Whitten ..... 166/100
3,468,386 9/1969 Johnson ..... 175/4.6
5,056,595 10/1991 Desbrandes ..... 166/100

FOREIGN PATENT DOCUMENTS 1657627 6/1991 Russian Federation ..... 166/55

*Primary Examiner*—Hoang Dang
*Attorney, Agent, or Firm*—David W. Westphal

[57] ABSTRACT

A wellbore completion system utilizes casing conveyed devices to establish a fluid communication path between a downhole formation and the casing string. Extendible pistons are mounted in the wall of the casing pipe string and are extended toward contact with the downhole formation after the casing is set. An explosive device is mounted in the pistons and includes a detonator and a shaped charge. The detonator is housed in a plug threaded into one end of the piston. The shaped charge is housed in a canister conveniently inserted into the other end of the piston. The explosives included in the system may thus be conveniently assembled at the well site. Explosive in the pistons are activated by a separately conveyed activation system which produces a pressure wave to detonate the explosives and establish fluid communication between the casing and formation.

20 Claims, 4 Drawing Sheets

CASING CONVEYED PERFORATOR

This application is a 371 of PCT/US93/09689 filed Oct. 7, 1993.

FIELD OF THE INVENTION

This invention relates to completing a well traversing earth formation in a borehole and more particularly to completing the well by means of perforating devices positioned on a casing string and also by using explosive devices located on the casing string to open normally closed flow path members extending between the casing string and earth formation traversed by a borehole in which the casing string is positioned.

BACKGROUND OF THE INVENTION

In the process of establishing an oil or gas well, the well is typically provided with an arrangement for selectively excluding fluid communication with certain zones in the formation traversed by the well to avoid communication with undesirable fluids. A typical method of controlling the zones with which the well is in fluid communication is by running well casing down into the well and then sealing the annulus between the exterior of the casing and the walls of the wellbore with cement. Thereafter, the well casing and cement may be perforated at preselected locations by a perforating device or the like to establish a plurality of fluid flow paths between the pipe and the product bearing zones in the formation. Unfortunately, the process of perforating through the casing and then though the layer of cement dissipates a substantial portion of the energy from the perforating device and the formation receives only a minor portion of the perfcrating energy.

Conventional perforating systems can be fixed inadvertently in that they are usually armed when extended into a wellbore and stray electrical signal or charge can cause premature firing which is a potential safety and operation problem.

Conventional perforating systems are quite expensive especially in terms of the rig time necessary to run a perforating gun into a well. This is particularly true for tubing conveyed systems where pipe is made up to run a perforating gun into a high angled hole for example.

Additionally, when completing high angled or horizontal borehole sections in a well, whether cased or in open holes, it is often a problem getting perforating apparatus into the high angled section because the gravity factor may not be sufficient to assist in running the equipment and friction between the equipment and borehole walls or pipe further hinders such operations. For this same reason it is difficult in many cases to run casing into such a well, and when casing is installed, the typical bow spring centralizers which are used are ineffective and it is therefore difficult to center the casing in the borehole in order to effectively cement the casing.

Accordingly, it is an object of the present invention to provide a method and apparatus for opening a flow path between the casing string and the formation in a wellbore which overcomes or avoids the above noted limitations and disadvantages of the prior art.

It is a further object of the present invention to provide a method and apparatus for perforating a wellbore wherein a casing string is centered in the wellbore to provide for effective cementing of the casing even when installed in a high angle borehole, and also wherein perforating charges are directed into the formation without penetrating the casing pipe and additionally wherein the casing pipe is in an underbalanced pressure condition.

It is yet another object of the present invention to provide a safe and less expensive method and apparatus for establishing a fluid communication path between the interior of casing pipe set in a borehole and an earth formation by using explosives to selectively opening a plurality of flow path devices mounted in the casing wall.

SUMMARY OF THE INVENTION

The above and other objects and advantages of the present invention have been achieved in the embodiments illustrated herein by the provision of an apparatus and method for establishing a fluid communication path between the interior of casing pipe set in a borehole and an earth formation by using an explosive device to selectively opening a plurality of flow path devices extended between the casing pipe bore and the borehole wall. These explosive devices may include detonators and associated shaped charges which are arranged in a tubular member extended from the casing wall. Additionally, the detonators may be arranged to be detonated by a pressure or shock wave originating in the casing pipe and spaced from the tubular member.

Additionally, the charges are placed in extendable pistons mounted in a casing string and a pressure wave producing device is run into the casing string in a separate operation. The casing may also then be cemented before the charges are detonated. By placing the charges in pistons extendable from the casing string, the charges are directed into the formation without passing through the casing and/or cement. The charges can be loaded into the pistons at the well site and then the pistons are assembled into the casing pipe to ensure a safe operation In one embodiment, the system comprises a piston for being mounted in an opening in the peripheral wall of the pipe and for extending generally radially outwardly from the pipe to contact the wall of the wellbore wherein the piston includes an explosive device therein. The explosive device is comprised of a detonating charge which is positioned in a plug that closes the piston to fluid communication between the casing and formations. A rupture disc separates the detonating charge from the casing bore. A shaped charge is positioned in the piston adjacent the detonating charge.

The shaped charge is assembled in a canister which is conveniently assembled into the piston. The piston is then assembled into the casing wall. These operations may be performed at the well location to provide a more safe procedure. The explosive device is run into the borehole on the casing in an unarmed condition in that the initiating device for initiating the detonator is run into the casing after the casing is set in the wellbore.

A deploying device deploys the piston from a retracted position which is generally within the maximum exterior profile of the pipe to an extended position wherein the piston extends generally radially from the opening toward contact with the wall of the wellbore. Some of the pistons will contact the wall of the wellbore and other will not. A detonation device is then positioned in the wellbore for detonating the explosive device in the piston while the piston is in its deployed position against the wall of the formation so as to perforate the formation by an explosive proximate to the formation. The piston when extended serves to center the pipe in the borehole and is substantially clear of the inner bore of the pipe to render the bore of the pipe full open.

DETAILED DESCRIPTION OF THE PREFERRED EMBODIMENTS

Figure 1:
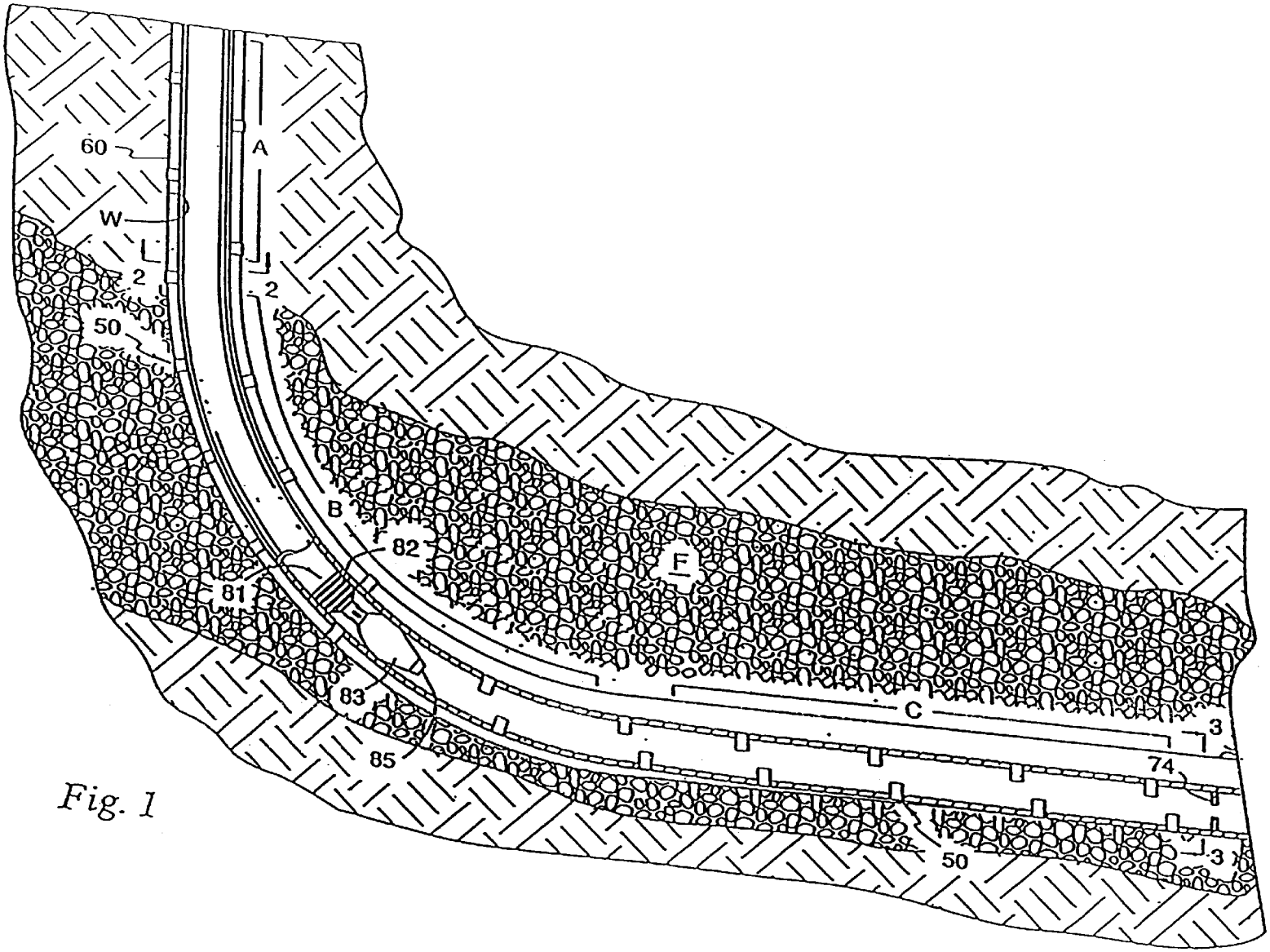
FIG. 1 is a cross-sectional view of a wellbore traversing earth formations with a casing string arranged therein and spaced from the walls of the wellbore by a plurality of downhole activated pistons which are shown being activated to an extended position and which embody feature of the present invention.

Referring first to FIG. 1 of the drawings, a wellbore W is shown having been drilled into the earth formations such as for the exploration and production of oil and gas. The illustrated wellbore W includes a generally vertical section A, a radial section B leading to a horizontal section C. The wellbore has penetrated several formations, one of which may be a hydrocarbon-bearing zone F. Moreover, the wellbore W was drilled to include a horizontal section C which has a long span of contact with the formation F of interest, which may be a hydrocarbon-bearing zone. With a long span of contact within a pay zone, it is likely that more of the hydrocarbon present will be produced. Unfortunately, there are adjacent zones which have fluids such as brine that may get into the production stream and thereafter have to be separated from the hydrocarbon fluids and disposed of at additional costs. Accordingly, fluid communication with such adjacent zones is preferably avoided.

To avoid such communication with nonproduct-bearing zones, wellbores are typically cased and cemented and thereafter perforated along the pay zones. However, in the highly deviated portions of a wellbore such as the radial section B and the horizontal section C of the wellbore, the casing tends to lay against the bottom wall of the wellbore, thereby preventing cement from encircling the casing and leaving a void for wellbore fluids such as brine to travel along the wellbore and enter the casing far from the formation from which it is produced. In the illustrated wellbore W, a casing string or liner 60 has been run therein which is spaced from the walls of the wellbore by a plurality of downhole activated pistons generally, indicated by the number 50, which serve to centralize the casing. The downhole activated pistons or centralizers 50 are retracted into the casing 60 while it is being run into the wellbore as is illustrated by the centralizers 50 in FIG. 1 which are ahead of an activator or pusher 82. Once the casing 60 is suitably positioned, the centralizers 50 are deployed to project outwardly from the casing as illustrated behind the activator or in FIG. 1. The centralizers 50 move the casing from the walls of the wellbore if the casing 60 is laying against the wall or if the casing is within a predetermined proximity to the wall of the wellbore W. This movement away from the walls of the wellbore will thereby establish an annular free space around the casing 60. The centralizers 50 maintain the spacing between the casing 60 and the walls of the wellbore W while cement is injected into the annular free space to set the casing 60. The pistons, however, are latched in an extended position and will thereby maintain the casing 60 centered even if the casing is not cemented.

Figure 3:
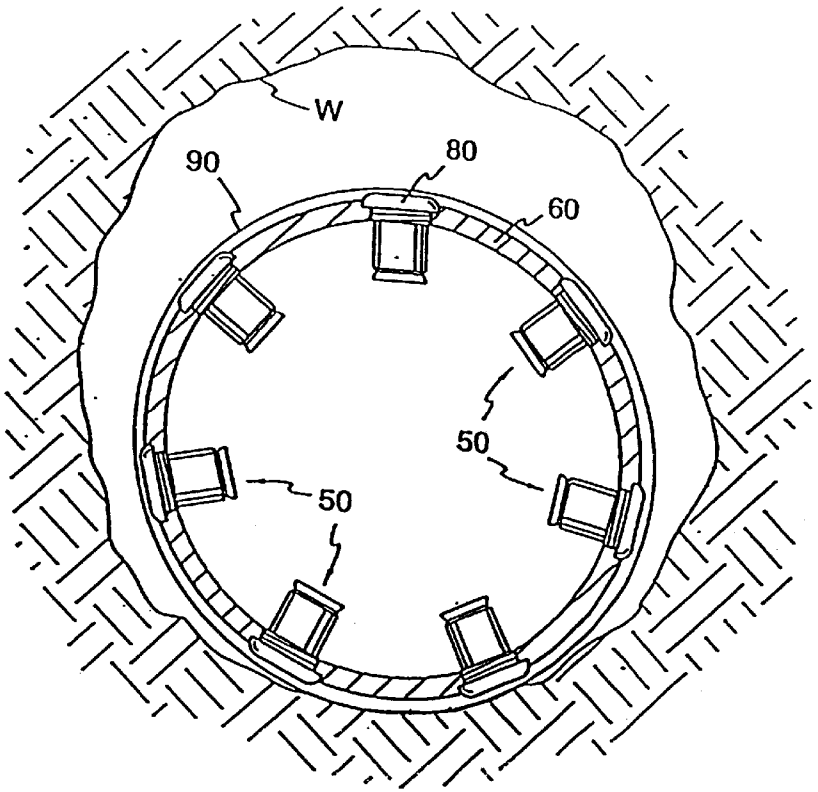
FIG. 3 is a cross-sectional end view similar to FIG. 2 prior to the casing being centralized and with the downhole activated centralizers in the retracted position.
Figure 2:
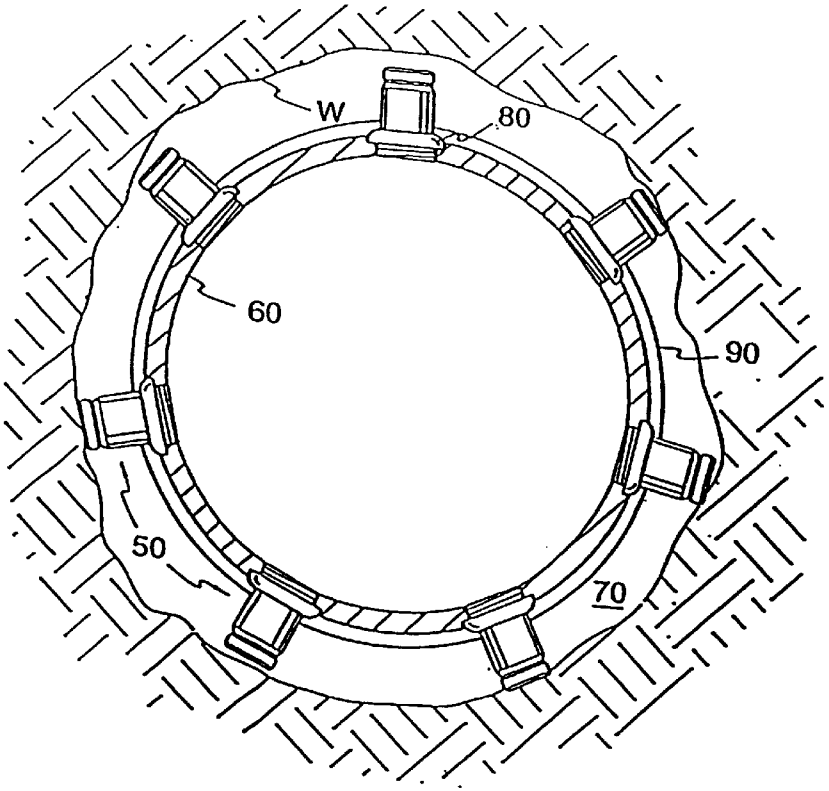
FIG. 2 is an enlarged cross-sectional end view of the casing taking along lines 2—2 in FIG. 1, wherein the centralizers are shown extended to center the casing string in the wellbore.

The centralizers 50 are better illustrated in FIGS. 2 and 3 wherein they are shown in the extended and retracted positions, respectively. Referring specifically to FIG. 2, seven centralizers 50 are illustrated for supporting the casing 60 away from the walls of the wellbore W although only four are actually shown contacting the walls of the wellbore W. It should be recognized and understood that the centralizers work in a cooperative effort to centralize the casing 60 in the wellbore W. The placement of the centralizers 50 in the casing 60 may be arranged in any of a great variety of arrangements. Applicants' related U.S. Pat. No. 5,228,518 which is incorporated herein by reference describes these arrangements in greater detail.

Referring again to FIGS. 2 and 3, the seven illustrated centralizers 50 are evenly spaced around the casing 60. As the casing is centralized, an annular space 70 is created around the casing within the wellbore. The casing 60 is run into the wellbore with the centralizers 50 retracted as illustrated in FIG. 3 which allows substantial clearance around the casing 60 and permit the casing 60 to follow the bends and turns of the wellbore W. Such binds and turns particularly arise in a highly deviated or horizontal hole. With the centralizers 50 retracted, the casing 60 may be rotated and reciprocated to work it into a suitable position within the wellbore. Moreover, the slim dimension of the casing 60 with the centralizers 50 retracted (FIG. 3) may allow it to be run into wellbores that have a narrow dimension or that have narrow fittings or other restrictions.

In FIGS. 2 and 3 and in subsequent figures as will be explained below, the centralizers 50 may present small bulbous portions 80 on the outside of the casing 60. It is preferable not to have any dimension projecting out from the casing to minimize drag and potential hangups while moving the string. However, as will be discussed below, the bulbous portions 80 are utilized in some embodiments especially in smaller diameter casings such is often used in horizontal holes when they are cased. It should also be recognized that the bulbous portions 80 are rounded to slide better along the walls of the wellbore and that the casing string 60 will include collar sections 90 that will extend out radially farther than the bulbous portion (see FIG. 3). Thus, the collar sections 90 present the maximum outer profile of the casing string even when the bulbous portions are present. The outward projection of the retracted centralizers 50 being within the maximum outer profile of the casing string 60 is believed to minimize any problems of running the casing.

Referring again to FIG. 1, a deploying device or pusher 82 which moves from the top of the casing to its bottom end is shown positioned within the horizontal curved section B of the casing string. The deploying device 82 is sized to push the pistons 50 from a retracted to an extended position. It is noted that the centralizers or pistons 50 behind or to the left of the pusher 82 are in an extended position having been engaged by the tapered nose portion 85 of the pusher. The tapered portion 85 engages the inner ends of the pistons and pushes them outwardly as the piston travels until the body portion 83 has passed the piston whereupon the piston will be fully extended and locked into an extended position as will be hereinafter described. The centralizers in front of the pusher 82 are still in a retracted position and consequently the horizontal portion C of the casing in front of the pusher is shown lying on the bottom side of the borehole. The upper vertical section A and radial section B are shown centered in that the pistons 50 have been deployed to an extended position. The activator device shown in FIG. 1 is a pumpable activator or deploying device having a tail pipe 81 which extends rearwardly from the main body portion 83 and seals the rear end of the device to the inside of the casing so that the device may be pushed down through the casing 60 by the application of hydraulic pressure. In addition, the activator may be run into the casing string on the end of a pipe string such as a drill pipe or coiled tubing wherein force is applied to the pipe string and thus to an activation device to engage and push out or extend the pistons 50.

Figure 4:
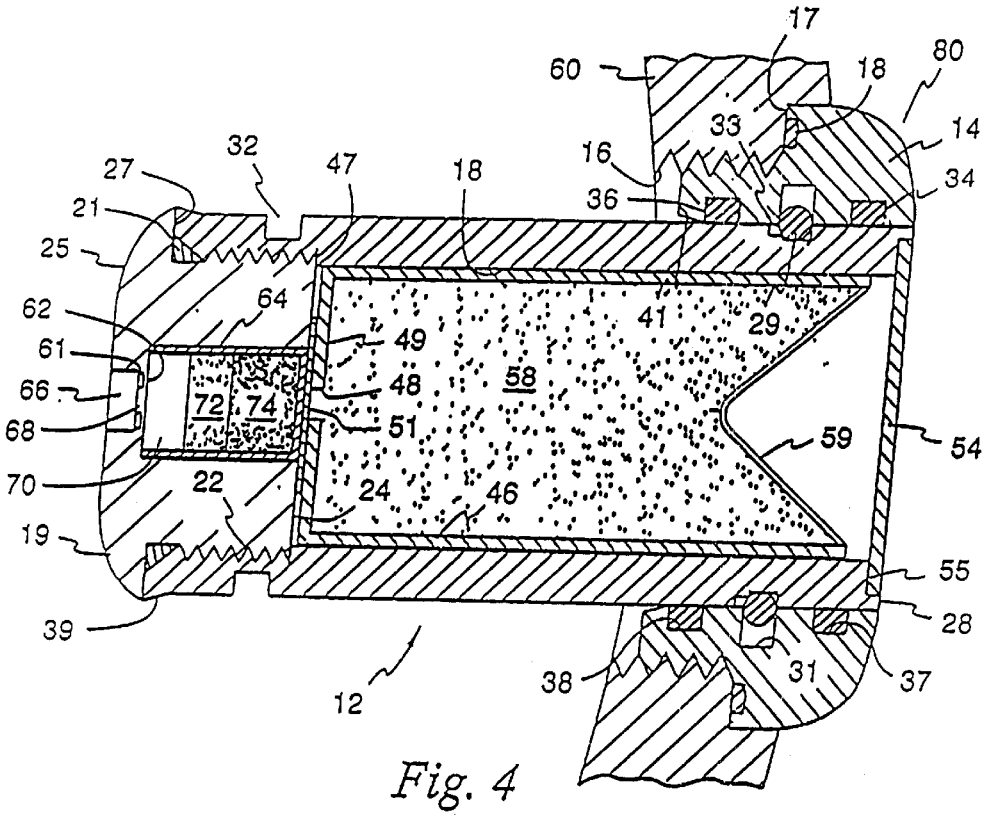
FIG. 4 is an enlarged cross-sectional view of a centralizer piston having a detonation device and shaped charge positioned therein, with the piston shown in a retracted or running-in position relative to the casing wall.
Figure 5:
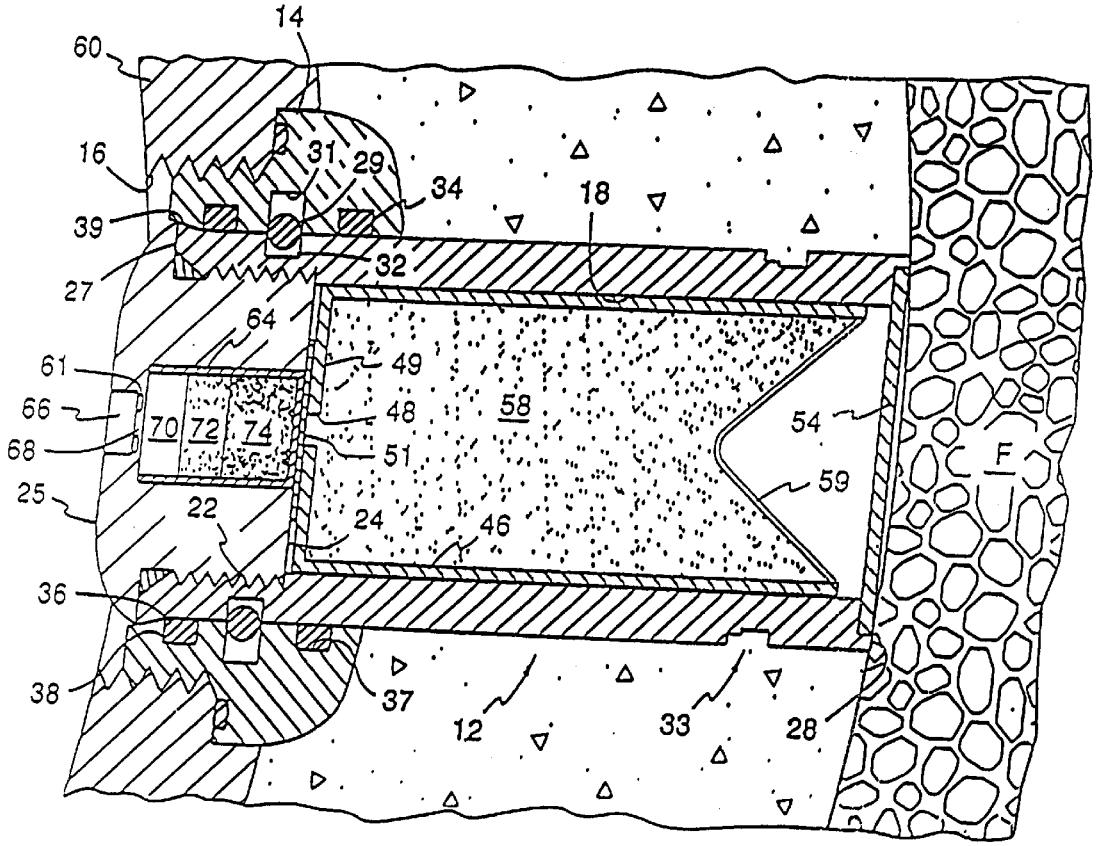
FIG. 5 is an enlarged cross-sectional view of the centralizer piston of FIG. 4 in an extended position wherein the outer end of the piston is in contact with an earth formation.

The centralizers or pistons may take many forms and shapes as is also described in U.S. Pat. No. 5,246,861. In the present application, the piston or centralizer 50 is shown in FIGS. 4 and 5 as including an explosive charge for perforating formations in the borehole. Referring first to FIG. 4, the centralizer 50 has a cylindrical or substantially cylindrical barrel portion or piston 12 which is slidably received in a bore in button 14. The button 14 is threadly received within a tapped hole 16 which extends Transversely through the wall of casing 60. A bulbous or rounded outer portion 80 extends outwardly slightly beyond the outside wall of the casing 60 but only to provide an adequate seat for the button 14 in thin wall smaller diameter casing and is constructed so that the outer extension of the bulbous portion 80 does not exceed the maximum profile of the pipe string which would normally be represented by the outside diameter of collars 90 in the casing string. The button 14 has a shoulder 17 formed at the base of the bulbous outer portion 80 that provides a surface for seating within a mating recessed surface at the outer end of the threaded hole 16 in the casing wall. The shoulder 17 forms a vertical surface on the button which fits against the mating vertical surface at the outer end of hole 16. An O-ring 18 is arranged within a groove on the shoulder 17 to provide a seal between the shoulder 17 and a vertical face at the end of hole 16. The button 14 is arranged so that its inner end does not extend into the interior of the casing 60. The piston 12 is arranged for axial movement through the button 14 from a retracted position (FIGS. 3 and 4) to an extended position (FIGS. 2 and 5). The piston 12 and the button 14 are mounted into casing 60 so that their axis are collinear and directed radially outwardly with respect to the axis of the casing 60. The piston 12 includes a plug 19 secured in an interior bore or passageway 18 in the piston by screw threads 22. An annular sealing ring 21 is positioned between the plug 19 and the inner end of piston 12. The piston 12 shown in FIGS. 4 and 5 also serves as a housing for a perforating device. The plug 19 is called an initiator plug in that it carries an explosive detonator device for initiating detonation of a shaped charge in the piston. The plug 19 does not fill the entire passageway 18 but is rather approximately the thickness of the casing 60. The plug 19 further includes a rounded inner end face 25 and a flat distal end face 24. The rounded surface 25 on the inner end of plug 19 is provided for facilitating the use of a deploying device to push the centralizer 50 into an extended position.

The distal end 28 of the piston 12 may be chamfered or tapered inwardly to ease the installation of the piston 12 into the button 14. The piston 12 is mounted in a central bore in the button 14 which is preferably coaxial to the opening 16 in the casing 60 and is held in place by a snap ring 29. The snap ring 29 is located in a snap ring groove 31 milled in the wall of the interior bore of the button 14.

Piston 12 includes two radial piston grooves 32 and 33 formed in the exterior cylindrical surface of the piston 12. The first of the two piston grooves is a circumferential securing or locking groove 32 which is positioned adjacent the inner end 27 of piston 12 to be engaged by the snap ring 29 when the piston is fully extended. The second of the two grooves is a circumferential retaining groove 33 positioned adjacent the distal end 28 of the cylinder 12 to be engaged by the snap ring 29 when the piston is in the retracted or running position as shown in FIG. 4. As the piston 12 is illustrated in FIG. 5 in the extended position, the snap ring 29 is engaged in the radial locking groove 32.

The snap ring 29 is made of a strong resilient material arranged to expand into the snap ring groove 31 when forced outwardly and to collapse when unsupported into the grooves 32 and 33 when aligned therewith. A particular arrangement of snap ring and grooves is shown in greater detail in Applicants' copending U.S. application Ser. No. 08/051,032 now U.S. Pat. No. 5,346,016, incorporated herein by reference.

Once the casing 60 is positioned in the wellbore for permanent installation, the pistons are deployed to the extended position. The deploying method provides a deploying force on the inner end of each piston to overcome the resistance of the snap ring in the retaining groove 33 and cause the snap ring 29 to ride up and out of the retaining groove 33 whereupon the snap ring 29 is pushed up into the snap ring groove 31 within the button 14. This allows the piston to move out into the annular space of the wellbore. Once the piston encounters the wellbore wall, it will then lift the casing off of the wellbore to centralize the casing until such time as the snap ring 29 aligns with and expands into the locking groove 32. The pistons should be of such a length that the pistons can be fully deployed to the locking groove 32 while giving the maximum amount of centralization. Once the pistons are fully deployed, the inner surface 25 on the plug 19 will be substantially clear of the casing bore for all practical purposes, and the casing bore should be substantially full opened.

The button 14 further includes a sealing arrangement to provide a pressure tight seal between the piston 12 and the button 14. In particular, the button 14 includes two O-rings, 34 and 36, which are positioned on either side of the snap ring 29 in O-ring grooves 37 and 38, respectively. The O-rings 34 and 36 seal against the exterior of piston 12 to prevent fluids from passing from one side of the casing wall to the other through the bore of the button 14. The O-rings 34 and 36 must slide along the exterior of the piston 12 passing the piston grooves 32 and 33 while maintaining the pressure tight seal.

The piston 12 further includes an outwardly tapered enlarged diameter peripheral edge 39 on its inner end 27, which edge 39 is larger than the bore in button 14 that receives the piston 12. Thus the edge 39 serves as a stop against the button 14 to limit the outward movement of the piston 12. The inside face of button 14 includes a chamfered edge 41 for engaging the outwardly tapered peripheral edge 39 on the piston when the inner end 27 of the piston is approximately flush with the inner end face of the button 14. Therefore, while the extended piston 12 is recessed into the button 14 and clear of the interior bore of the casing 60, the inwardly facing rounded surface 25 of the initiator plug extends slightly into the bore of the casing for purposes to be described so that it is substantially clear of the bore to render the casing bore fully open to permit passage of the deploying device 82 or other similar device such as packers or the like that would be passed through the bore of a casing string.

The term full open bore within the context of oil field terminology, encompasses a situation such as the present wherein for all practical purposes equipment can be moved through the bore of a pipe unrestrictedly.

Still referring to FIG. 4, the inner bore 18 of the piston 12 is shown having a shaped charge insert installed therein. The shaped charge insert includes a cup-shaped canister or carrier 46 which is sized to be press fit into the bore 18 of the piston 12. A locking compound is used to hold the canister 46 in the bore cavity of the piston. The carrier 46 is nested against a shoulder 47 in the piston bore 18, the shoulder 47 being the end of the threads 22 which are cut in the bore 18 of the piston at its inner end to receive plug 19. An ignition hole 48 is formed in the inner wall 49 of the cup-shaped carrier 46. A thin metal foil 51 is placed over the outer surface of hole 48 facing the plug 19. At the distal end of the piston 12, an outer end cap 54 is fitted within a recessed shoulder 55 and is held in place by its press fit and a locking compound. A shaped charge 58 is positioned in the canister 46 with a conical depression 59 in the distal end of the face of the shaped charge facing outwardly. The use of canister 46 provides a means to conveniently load the shaped charge 58 into the piston bore 18 at the well site. The use of preloaded canisters also provides a means to select a variety of charges or other services which may be loaded into the bore 18. By loading the shaped charges or other explosive into the piston at the well site, the presence of such explosive in the completion system can be avoided until just prior to the casing being installed, if need be, to assure maximum safety. Additionally, if the shaped charge is loaded into the piston bore 18 and pressed therein to hold its shape and position in the bore, the pressure required to load the charge in the bore may cause the piston 12 to swell slightly which, in turn, may affect its ability to be moved through the button 14 to an extended position. The canister 46 is sized to be easily positioned in the bore 18 and is held therein by an adhesive or the like. The seal 54 is then installed over the distal end of bore 18.

The shaped charge 58 is shaped at its inner end to conform to the flat inner wall 49 of the canister. This flat shape is designed to provide a rearwardly directed force in the direction of the plug 19. The end 49 of the canister engages the distal end of the plug 19 so that the rearwardly directed force of the detonated shaped charge is applied to the plug to strip the plug from the threaded connection 22 and thus move the plug into the bore of the casing pipe 60. This leaves a flowport or passage through the cylinder 12 to provide a fluid flowpath between the casing bore and the formation being completed. A major portion of the explosive force generated by the shaped charge 58 is directed toward the formation wall toward which the niston 12 has been extended and will be effective to penetrate any material such as cement, between the extended piston and the formation, and the formation itself. If the piston 12 is fully engaged with the formation as shown in FIG. 5, all the explosive force directed toward the distal end of the piston will be utilized to penetrate the formation.

The opposite inner end of the piston 12 has the plug 19 enclosing the inner end. The plug 19 has a cylindrical recess 62 which is formed from the inner side of the plug 19 for receiving a detonator cup 64. The cup 64 is held in place within the recess 62 by means of a thread locking compound or the like. On the rounded outer surface 25 of the plug 19 and central to the plug 19, a recess 66 is formed in the outer wall surface 25 opposite the recess 62 on the interior of the plug 19. The recess 66 may be for example ⅛ inch in diameter and approximately 0.040 inches deep to leave an integral rupture disc portion 68 formed between the recesses 62 and 66. The rupture disc may be on the order of 0.0275 inches thick. The cup 64 which is assembled within the recess 62 has provided within its interior bore a detonating system which is housed in the shell or cup 64. The detonating system may include at least one base charge 74 of a detonating explosive composition located in the bottom of the shell 64 as shown, and a priming charge 72 of a heat sensitive explosive composition located adjacent to the base charge. The detonator shown includes an open volume 70 between the priming charge 72 and the rupture disc 68. In this application, the space between the top surface of the priming charge 72 and the rupture disc 68 is optional and can be any distance up to several inches of space is available. Rupture disc 68 may be adapted by any suitable means known in the art to seal the end of the tubular shell 64. Typical base charges that can be used are pentaerythritol tetranitrate (PETN), cyclortrimethylene trinitramine (RDX), cyclotetramethylene tetranitramine (HMX), picrylsulfone, nitromannite, trinitrotoluene (TNT), hexanitrostilbene (HNS), lead azide, and the like. Covering the base charge is a priming charge 72 that can be flat as shown or tapered and embedded in the base charge. Typical priming charges are of lead azide, lead styphanate, diazodinitrophenol, mercury fulminate and nitromannite. Mixtures of diazodinitrophenol potassium chlorate, nitromanite/diazodinitrophenol and lead azide/lead styphanate also can be used. A separate layer of lead styphanate or a layer of a mixture of lead styphanate can be placed over lead azide. The tubular shell 64 and the rupture disc 68 can be aluminum, magnesium, brass or any methal, plastic, or other suitable material.

It is noted that by installing the detonator explosives 72 and 74 in the cup 64, the detonating device can be conveniently assembled into the plug 19 at the well site. This permits maximum safety in the procedure of assembling the completion system described herein. The cup or shell 64 can be held in place by means of an adhesive substance or the like.

In FIG. 5 of the drawings, the centralizing piston 12 is shown having been moved to an extended and locked position wherein the distal end 28 of the piston is in contact with the bore hole wall. A deploying device 82 such as is shown in FIG. 1 has been moved through the interior bore of the casing string to contact the outer surface 25 of plug 19 on the inner end of the piston. Once the piston is extended and locked in its predetermined fixed position as shown in FIG. 5, the perforating apparatus is now in a position to permit perforation of the formation which the wellbore traverses. It is noted, that alternatively the pistons 12 may be extended by the application of hydraulic pressure to the interior of the casing pipe string which provides a force that impinges on the inner end of the piston to move the pistons outwardly.

It is to be noted that one particular advantage of the apparatus described herein is that the centralizing piston and a button 14 which guides the piston, when provided, may be assembled within the casing string at some time just before the casing is run into the wellbore W. Accordingly, the handling of the casing pipe up to the point that it is being installed in the wellbore is not encumbered by having the explosive devices installed during shipping and handling of the casing prior to its installation. It is also to be noted that there is no device present within the system thus far described to initiate the explosive devices within the piston so that such handling in the configuration described above is considered safe and will not unnecessarily endanger the personnel who are installing the devices in the casing or installing the casing within the wellbore.

Figure 6:
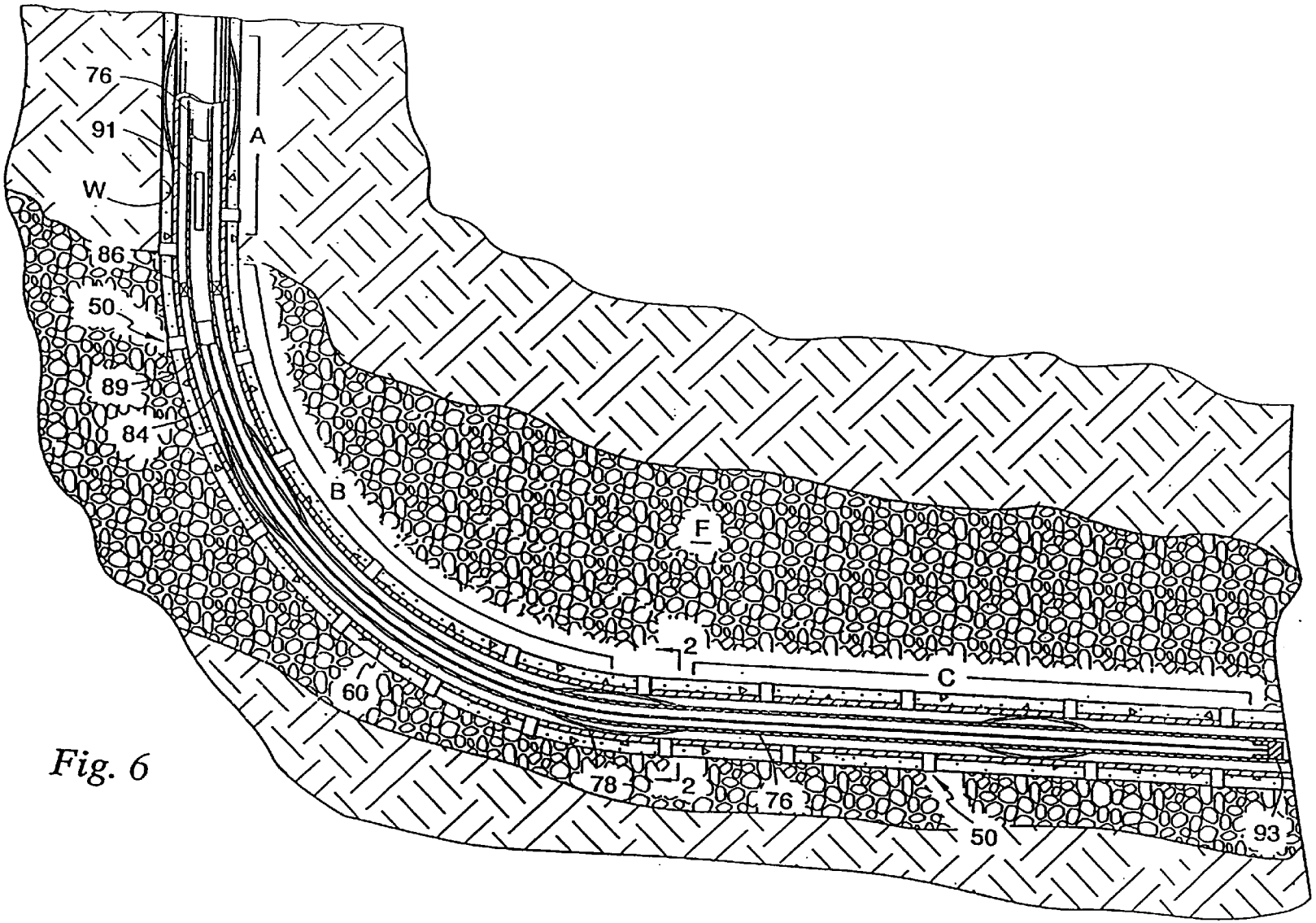
FIG. 6 is a cross-sectional view of a wellbore showing a casing centralized in a high angled or horizontal borehole by pistons in an extended position and further showing a pressure wave generating device positioned in the casing by means of a tubing string.

Referring now to FIG. 6 of the drawings, the casing 60 is shown having been run into a well. The centralizers are shown having been extended by means of a pumpable activator device 82 such as shown in FIG. 1 or by the application of hydraulic pressure to the casing string at the surface. Hydraulic activation is accomplished by closing a valve at the base of the casing string and applying the necessary activation or deploying force required to move the pistons from the retracted position to the extended position. Accordingly, pumps or other pressure generating mechanism would provide the necessary deploying force for the pistons.

Once the casing has been centralized within the wellbore, an annulus of cement can be injected and set around the entire outer periphery of the casing, over some appropriate interval of casing, to seal the casing from the formation. As suggested by the present invention, the casing string with the centralizer system as described is arranged so that in those portions of the wellbore where it is desired to have a centralizing only function for the centralizers, the centralizers are not configured so as to provide a perforating function. However, within a zone opposite formation F as shown in FIG. 6, where it is desirable to open the casing to permit the recovery of fluids from the formation into the casing string and to perforate the formation, the centralizers are likely to be of the embodiment shown in FIGS. 4 and 5 which include a shaped charge device or the like for perforating the formation to be produced. Alternatively, if a shaped charge is not provided, an explosive device is incorporated in the bore 18 of piston 12 to selectively open a flowport through the piston 12 to provide a fluid flowpath from the formation to the casing pipe string.

In the initial installation of the casing within the wellbore, it is important to note that when the centralizers are not extended the casing can be rotated and reciprocated to work past tight spots or other interferences in the hole. These retracted centralizers 50 also do not interfere with the fluid path through the casing string so that fluids may be circulated through the casing to clear cuttings from the end of the casing string. Also the casing interior can be provided with fluids that are less dense than the wellbore fluids, in the annular space, causing the casing string to float. Clearly, the centralizers 50 of the present invention permit a variety of methods for installing the casing into its desired location in the wellbore.

Once the casing 60 is in a suitable position, the centralizers are deployed to centralize the casing. As discussed above, there are several methods of deploying the centralizers. Once the pistons are all deployed and the snap rings have secured them in the extended fixed position projecting outwardly toward the wall of the wellbore, the cement may be injected by well known techniques into the annulus formed by the centralizing of the casing within the borehole.

The cement around casing 60 may be allowed to set while the production string is assembled and installed into the casing. It is important to note that at this point in the process of establishing the well, the casing and wellbore are sealed from the formation. Accordingly, there is as yet no problem with controlling the pressure of the formation or with loss of pressure control fluids into the formation. In a conventional completion process, the perforation string is assembled to create perforations in the casing adjacent to the hydrocarbon bearing zone. Accordingly, high density fluids are provided in the wellbore to maintain a sufficient pressure head against the affect of formation pressure to avoid a blowout situation. While the production string is assembled and run into the well some of the wellbore fluids, in an overbalance condition, may be forced into the formation. Accordingly, the production string must be installed quickly to begin production the well once the well has been perforated. However, with the present invention, such problems are avoided. Once the casing is set in place, the production string may be assembled and installed in the casing before perforation of the formation is performed. Once the production string is in place in the well, adequate surface controls are in place to prevent a blowout, so that the casing and production string can be in an underbalanced condition. The packer 86 as shown in FIG. 6 seals off the casing string annulus between the production tubing 89 and the casing 60. This packer is set above the pistons 50 to be opened as flow paths. Thus, production may begin when communication is established with the formation, such as by perforation in any under balanced condition. Accordingly, the well is brought on-line in a more controlled manner. It is well documented that perforating underbalanced gives higher production rates in many wells. Underbalanced perforating is a term which describes the concept of having a lower pressure in the well than in the adjacent formation. When a well is perforated underbalanced the pressure in the formation is allowed to enter the wellbore. When a well is perforated overbalanced the pressure in the wellbore is allowed to enter the formation. The flow of fluids into the formation in overbalanced perforating can damage the formation reducing permeability and later the flow into the wellbore. Underbalanced perforating will not cause this formation damage. It also appears that damage caused by the perforating itself is reduced if a well is perforated underbalanced. Wells can be perforated underbalanced with wireline guns but the well must be overbalanced when the production tubing is run in the well or a major safety problem exists. The casing conveyed perforating described herein allows underbalanced perforating in all types of wells and does not require that the well ever be overbalanced because the production tubing can be present in the well during the perforating and can be placed immediately on production without ever having to kill the well.

FIG. 6 shows an apparatus and system for initiating the detonators within the detonator cup 64 (FIG. 5) in the pistons, in order to fire the shaped charges and penetrate the formation. Firing the detonators will also open the piston to fluid flow between the formation and casing string. A small diameter pipe string such as production tubing 76 or coiled tubing is run into the interior of the casing string after the centralizers 50 are extended but before the detonators are fired. The casing $S^4$. ring may be in the form of a long string which extends from the bottom of the wellbore to the surface or in the form of a liner where the casing is required over some specific zone in the wellbore which does not extend to the surface. Such a liner is normally set using drill pipe. However, the casing may or may not be cemented in place. A detonating cord 84 may be pre-installed in the lower end of the tubing string 76 and run into the well with the tubing string. Alternatively, the tubing string may be located in the casing string and then the detonating cord is run into the tubing string. In the latter case, in order to set the detonating cord 84 in place, the bottom of the tubing string can be provided with a latching mechanism 93. After the tubing 76 is run into the casing string, a sinker bar with detonating cord trailing behind, can be lowered into the tubing string and latched inside of the tubing. Alternatively, a device can be pumped to the latch 93 with a detonating cord trailing. A perforating head 89 would be run at the trailing, upper end of the detonating cord 84 to provide a means for initiating the detonating cord. Once the tubing is run, a production packer 86 can be set. At this time a sinker bar 91 can be dropped which would strike the perforating head and initiate the detonating cord. Alternatively, a wireline could be connected with the detonating cord or perforating head in order to initiate the detonating cord.

The detonating cord is initiated by dropping a similar bar 91 or using an electrical wireline or as another alternative, using a hydraulically actuated perforating head. Once the detonating cord is initiated, it results in the development and propagation of a pressure wave within the pipe string 76. This pressure wave is then communicated through the fluid in the pipe 76 and casing 60 to the plug 19 at the inner end of the cylinders 12. If necessary, the pipe string 76 may be centered in the casing by means of conventional centralizers 78. Centering the pipe string 76 in the casing string may be important in view of the importance of propagating a pressure wave to the cylinders 12 on all sides so that the force of this pressure wave is sufficient to rupture the disc 68 in the plug 19. This rupture of disc 68 will sequentially initiate the powders 72 and 74 within the cup 64 positioned in the plug 19. Tests have shown that initiation of the detonator will take place without the provision of an air space 70 in the cup 64 by locating powders adjacent to the ruptured disc 68. The amount of pressure required to rupture the disc is increased when the air space is eliminated; however, detonation does take place. It is believed that the principle behind the detonation is an adiabatic compression within the cup 64 which is sufficient to initiate the powders 72, 74 therein. Therefore, it appears to only be necessary to generate sufficient pressure within the interior of the casing bore to cause the rupture disc 68 to rupture which will thereby initiate the detonator housed within the cup 64. When a shaped charge is present in the piston 12, initiation of the detonator is communicated through the opening 48 within the carrier 46 to detonate the shaped charge 58. This detonation produces a penetrating force that is directly applied to the formation F so that all the outwardly directed energy of the shaped charge is applied to perforation and fracturing of the formation. Detonation of the shaped charge 58 also removes the plug 19 and end cap 54 to open the piston 12 for fluid flow.

In the configuration shown in FIG. 6, the smaller diameter pipe 76 housing the detonating cord, may be provided with slots or holes in the outside walls thereof to facilitate transmission of a pressure wave emanating from the detonating cord to the perforating cylinders 12. However, experiments have shown that a pressure wave may be propagated through the walls of solid pipe which is sufficient to initiate the detonators within the plug 19 on the cylinders 12. The system shown in FIG. 6 with a production packer 86 set in place will permit the completion to take place with an under-balanced fluid in the pipe string, so that upon perforation of the formation F formation, fluids may be readily received into the casing string through the now open cylinder 12 and from there into the production tubing 76 for conveyance to the surface.

In the process of perforating the formation as described in the present invention, it is noted that the word "penetrating" is used to describe the process for opening a communication path into the formation. The reason that penetrating the formation is desirable is that the permeability of porous reservoir rock is usually reduced or plugged near the wellbore due to the leakage of drilling fluids used in the drilling operation into the first few inches of the formation material surrounding the wellbore. This reduces permeability near the wellbore and is referred to as skin damage. In the present perforating technique, the shaped charges are not designed to make a hole in the casing as in a normal perforating system, but rather to establish communication with the reservoir rock and to penetrate the rock itself with a fracturing and penetrating blast that extends communication beyond the skin damage. Whereas normal shaped charges in a perforating system are positioned within the casing string and must therefore progress through the fluids within the casing string, the steel casing string wall, cement if it is in place, and then into the skin damaged portion of the reservoir. In the present system the shaped charge is positioned directly against the formation and thus a much greater portion of the energy developed by the shaped charge is applied to the formation rock itself.

It is readily appreciated that other methods could be used to develop a pressure wave for initiating the shaped charge. Also, it is readily seen that a variety of detonators might be used to initiate the explosion of the shaped charged within the centralizing cylinder 12. Additionally, while a casing string has been primarily described as the device for carrying the extendible pistons or flow path devices into the borehole, it is readily appreciated that liners serve the same purpose and therefore any functional substitute for a casing is intended to be covered by this invention. Therefore, while particular embodiments of the present invention have been shown and described, it is apparent that changes and modifications may be made without departing from this invention in its broader aspects and therefore the aim in the appended claims is to cover all such changes and modifications as fall within the true spirit and scope of this invention.

We claim:

1. A completion system for use in a borehole drilled into earth formations wherein it is desirable to establish a fluid communication path between the interior of a pipe string in the borehole and an earth formation traversed by the borehole, comprising:

a casing pipe string for placement in the borehole;

openings formed in the wall of said casing pipe string;

tubular passage means mounted for movement in said openings;

canister means having a shaped charge therein, said canister means being sized for conveniently being assembled into one end of said tubular passage means, said canister blocking said tubular passage means;

explosive means mounted in the other end of said tubular passage means for detonating said shaped charge; and detonating cord means arranged to be operated when it is out of direct contact with said tubular passage means when extended for providing a pressure wave upon operation thereof to activate said explosive means.

2. The completion system of claim 1 wherein said shaped charge is arranged to direct a portion of its explosive energy toward the bore of said casing pipe string to ensure opening of said tubular passage means.

3. The completion system of claim 1 and further including activation means for being conveyed into said pipe string to a position that is spaced from said explosive means after said explosive means and shaped charge are carried into the borehole on said pipe string, said activation means being operable to activate said explosive means; and means for operating said activation means.

4. The completion system of claim 3 wherein said activation means is comprised of a selectively operable pressure wave producing device which is positioned within said pipe string, which device, when operated, produces a pressure wave or pulse which activates said explosive means.

5. The completion system of claim 3 wherein said activation means is a detonating cord which is longitudinally positioned within the interior of said pipe string.

6. The completion system according to claim 5 wherein said detonating cord means is conveyed within a smaller pipe string which is positioned within said casing pipe string.

7. The completion system of claim 6 wherein said smaller pipe string is a coiled tubing.

8. The completion system of claim 6 wherein said smaller pipe string houses the detonating cord and wherein said smaller pipe string has openings in its outer wall to facilitate travel of a pressure wave emanating from said detonating cord through said openings into contact with explosive means carried in said casing pipe string, when said detonating cord is operated.

9. A method for perforating an earth formation traversed by a borehole to provide a fluid communication path between a borehole casing pipe string and the earth formation, comprising the steps of:

positioning normally closed flow path devices on the casing pipe string to provide a flow path between the casing pipe string and the earth formation;

positioning perforating charges in the normally closed flow path devices;

closing each flow path devices with a rupture device;

positioning the casing pipe string in the borehole where formations are to be perforated;

positioning an elongated detonating explosive device in the pipe string after the pipe string is positioned in the borehole;

activating the explosive device to produce a pressure wave within the interior bore of the casing pipe string having the perforating charges positioned thereon, to rupture the rupture devices and detonate the perforating charges; and directing a portion of the energy of the detonated perforating charges toward the interior bore of the pipe string to open the normally closed flow path devices.

10. The method of claim 9 wherein said perforating charges are positioned within pistons, which pistons are movably mounted within the side walls of portions of the pipe string, and further including;

moving the pistons from a retracted position substantially within the profile of the outside diameter of the pipe string to an extended position wherein one end of the pistons is extended toward contact with the earth formations.

11. A The method of claim 10 wherein said pistons are moved to an outwardly extended position by moving a deploying device through the inside of the pipe string into contact with an inner end of the retracted pistons to slidably move the pistons through the wall of the pipe to an outwardly extended position; and latching the piston in the outwardly extended position.

12. The method of claim 9 and further including installing a detonator in proximity to the perforating charges which detonator is responsive to the produced pressure wave to detonate the perforating charge.

13. A completion system for use in a borehole drilled into earth formations to establish a fluid communication path between the interior of a pipe string and the formation traversed by the borehole, comprising;

a pipe string for positioning in the borehole;

a tubular flow path device positioned in the wall of the pipe string and having a bore portion;

explosive means positioned in said bore portion and arranged so that a portion of its explosive energy when activated is directed toward the interior bore of the pipe string to open said bore portion to fluid communication;

plug means releasably held in said bore portion and sealing said flow path from fluid communication between said pipe string and the formation; and a rupture disc on the inner end of said plug means which when ruptured provides a means to communicate a pressure wave to said explosive means.

14. The completion system of claim 13 wherein said explosive means includes a detonator positioned in said plug means.

15. The completion system of claim 13 wherein said explosives means includes shaped charge means arranged so that a major portion of its explosive energy is directed toward the distal end of said flow path device and a minor portion of its explosive energy is directed toward said plug means.

16. The completion system of claim 13 wherein said explosive means includes a detonator means arranged in said plug means and a shaped charge adjacent said plug means between said plug means and the distal end of said flow path device.

17. The completion system of claim 13 and further including a canister for housing said shaped charge within said bore portion, said canister being arranged for easy insertion into said bore portion from the distal end of said flow path device.

18. A completion system for use in a borehole drilled into earth formations to establish a fluid communication path between the interior bore of a casing pipe string and a formation traversed by the borehole, comprising;

extendible pistons mounted in the wall of the casing pipe string, said pistons having a bore extending through the piston;

a canister for convenient insertion in said bore, said canister having an explosive charge positioned there; and wherein said canister is slip fitted into the base of said piston and further including adhesive means for holding said canister in place within said bore.

19. The completion system of claim 18 and further including plug means in the inner end of said bore and closing said bore from fluid flow therethrough, said charge is directed toward said plug means to remove said plug means from said bore.

20. The completion system of claim 19 wherein a major portion of said explosive charge when detonated is directed toward the formation.

* * * * *

UNITED STATES PATENT AND TRADEMARK OFFICE

CERTIFICATE OF CORRECTION

PATENT NO.: 6,009,947

DATED: January 4, 2000

INVENTOR(S): Dennis R. Wilson, Malak E. Yunan, Wilber R. Moyer, and Larry K. Moran

It is certified that error appears in the above-identified patent and that said Letters Patent is hereby corrected as shown below:

Column 3, line 6, --feature-- should be --features--.

Column 4, line 33, --binds-- should be --bends--.

Column 7, line 58, --niston-- should be --piston--.

Column 10, line 12, --production-- should be --producing--.

Column 10, line 57, --$S^4$.ring-- should be --string--.

Column 14, Claim 19 should read as follows:

Signed and Sealed this

Nineteenth Day of September, 2000

*Attest:*

Q. TODD DICKINSON

*Attesting Officer*

*Director of Patents and Trademarks*